US011795518B2

(12) United States Patent
Fujimura et al.

(10) Patent No.: US 11,795,518 B2
(45) Date of Patent: Oct. 24, 2023

(54) NON-ORIENTED ELECTRICAL STEEL SHEET AND METHOD OF MANUFACTURING STACKED CORE USING SAME

(71) Applicant: NIPPON STEEL CORPORATION, Tokyo (JP)

(72) Inventors: Hiroshi Fujimura, Tokyo (JP); Satoshi Kano, Tokyo (JP); Miho Tomita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 82 days.

(21) Appl. No.: 17/257,466

(22) PCT Filed: Oct. 24, 2019

(86) PCT No.: PCT/JP2019/041767
§ 371 (c)(1),
(2) Date: Dec. 31, 2020

(87) PCT Pub. No.: WO2020/085448
PCT Pub. Date: Apr. 30, 2020

(65) Prior Publication Data

US 2021/0292863 A1 Sep. 23, 2021

(30) Foreign Application Priority Data

Oct. 24, 2018 (JP) ..... 2018-199857

(51) Int. Cl.

| | |
|---|---|
| ***C21D 8/12*** | (2006.01) |
| ***C22C 38/02*** | (2006.01) |
| ***C22C 38/00*** | (2006.01) |
| ***C22C 38/04*** | (2006.01) |
| ***C22C 38/06*** | (2006.01) |
| ***C21D 8/02*** | (2006.01) |
| ***C21D 9/00*** | (2006.01) |
| ***C21D 9/46*** | (2006.01) |
| ***H01F 1/147*** | (2006.01) |
| ***B21D 28/02*** | (2006.01) |

(52) U.S. Cl.
CPC ..... *C21D 8/12* (2013.01); *B21D 28/02* (2013.01); *C21D 8/0263* (2013.01); *C21D 9/0012* (2013.01); *C21D 9/46* (2013.01); *C22C 38/004* (2013.01); *C22C 38/02* (2013.01); *C22C 38/04* (2013.01); *C22C 38/06* (2013.01); *H01F 1/14775* (2013.01); *C21D 2261/00* (2013.01); *C22C 2202/02* (2013.01)

(58) Field of Classification Search
None
See application file for complete search history.

(56) References Cited

U.S. PATENT DOCUMENTS

| | | | | |
|---|---|---|---|---|
| 2009/0301609 | A1 | 12/2009 | Arita et al. | |
| 2013/0167987 | A1 | 7/2013 | Kim et al. | |
| 2019/0316221 | A1 * | 10/2019 | Yashiki | C21D 8/1272 |

FOREIGN PATENT DOCUMENTS

| | | | | |
|---|---|---|---|---|
| JP | 2003-213385 | A | 7/2003 | |
| JP | 2005-113158 | A | 4/2005 | |
| JP | 2008-50685 | A | 3/2008 | |
| JP | 2008-50686 | A | 3/2008 | |
| JP | 2008-202070 | A | 9/2008 | |
| JP | 2010-31328 | A | 2/2010 | |
| JP | 2011-140683 | A | 7/2011 | |
| JP | 2014-503685 | A | 2/2014 | |
| JP | 2018-141206 | A | 9/2018 | |
| WO | WO-2018131710 | A1 * | 7/2018 | C21D 6/008 |

* cited by examiner

*Primary Examiner* — Anthony M Liang
(74) *Attorney, Agent, or Firm* — Birch, Stewart, Kolasch & Birch, LLP

(57) ABSTRACT

Provided are a non-oriented electrical steel sheet with which it is possible to improve steel sheet transferability even when punching is performed successively at high speed, and a method of manufacturing a stacked core using the same. The non-oriented electrical steel sheet contains, by mass percent, Si: 2.0 to 5.0%, Mn: 0.4 to 5.0%, Al≤3.0%, C: 0.0008 to 0.0100%, N≤0.0030%, S≤0.0030%, and Ti≤0.0060%, wherein the product of the contents of Mn and C is 0.004 to 0.05 mass $\%^2$, the yield strength in rolling direction is more than or equal to 600 MPa, and the Young's modulus is more than or equal to 200 GPa. In the method of manufacturing a stacked core, when manufacturing a stacked core using a progressive die, the steel sheet transfer speed V (m/s) satisfies expression (1). V: $V_{MIN}$ to $V_{MAX}$ (1) $V_{MAX}=(1/25)\sqrt{(t^2\times E\times YS)}$ (2) $V_{MIN}=(1/25)\sqrt{(t^2\times 120000)}$ (3) t: Steel sheet thickness (mm), E: Young's ratio (GPa), YS: Yield strength (MPa).

2 Claims, No Drawings

NON-ORIENTED ELECTRICAL STEEL SHEET AND METHOD OF MANUFACTURING STACKED CORE USING SAME

FIELD

The present invention relates to a non-oriented electrical steel sheet and a method of manufacturing a stacked core using the non-oriented electrical steel sheet, and particularly to a non-oriented electrical steel sheet having an excellent continuous punching property.

BACKGROUND

In the fields of electrical equipment, especially rotating machines, small and medium-sized transformers, electrical components, etc., where a non-oriented electrical steel sheet is used as an iron core material, there is an increasing demand for higher efficiency and smaller size.

Regarding the reduction of iron loss among the performance characteristics of a non-oriented electrical steel sheet, a method of increasing the content of Si, Al, etc. has generally been adopted from the viewpoint of reducing eddy current loss due to an increase in electrical resistance. Various improvement techniques have been proposed for increasing the magnetic flux density.

On the other hand, when a non-oriented electrical steel sheet is used in electrical equipment as an iron cores such as in rotating machines, it is necessary to consider changes in magnetic characteristics during processing. In particular, when a non-oriented electrical steel sheet is punched as an iron core material, the shape of the punched end face and the fastened portion not only affects the iron core performance, but also affects the stackability and formability of the iron core. That is, unless the iron core is formed into a predetermined shape, the magnetic characteristics as a material of the non-oriented electrical steel sheet cannot be exhibited.

Various non-oriented electrical steel sheets have been proposed, which have excellent magnetic characteristics as a material for an iron core of an electric device and also have excellent punching workability for facilitating molding into an iron core of an electric device.

Patent Document 1 discloses a non-oriented electrical steel sheet having an excellent punching workability and a high yield stress (400 MPa or more), characterized in that it comprises, in terms of by mass %, Si: 1.5% or more and 3.5% or less, Mn: 1.5% or less, Al: 0.2% or more and 3.0% or less, Mg: 0.0003% or more and 0.0050% or less, or Ti: 0.0010% or more and 0.010% or less, C: 0.0010% or more and 0.010% or less, the balance being Fe and unavoidable impurities, and that the crystal particle size d of the product sheet is 5 m or more and 40 m or less, and the relationship of $d \leq 50 \times (Si+0.5Al-2)$ is satisfied.

Patent Document 2 aims to provide a non-oriented electrical steel sheet having an excellent strength without sacrificing yield and productivity in punching process of a motor core and steel sheet production. The disclosed non-oriented electrical steel sheet is characterized in that it comprises, in terms of by mass %, C: 0.01% or more and 0.05% or less, Si: 2.0% or more and 4.0% or less, Mn: 0.05% or more and 0.5% or less, Al: 3.0% or less, Nb: 0.01% or more or 0.05% or less, the balance being Fe and unavoidable impurities, and that the content of Mn and C is, in terms of by mass %, satisfies Mn 0.6-10×C, and that the area ratio of the recrystallized portion of the steel sheet is 50% or more, and that it has a yield strength in a tensile test of 650 MPa or more, a breaking elongation of 10% or more, and the iron loss W10/400 of 70 W/kg or less.

Patent Document 3 aims to provide a non-oriented electrical steel sheet having an excellent punching workability, that facilitates molding into an iron core of an electric device. The disclosed non-oriented electrical steel sheet comprises a steel component comprising C: 0.003% or less, Si: 1.0% or more and 3.0% or less, Al: 0.1% or more and 3.0% or less, Mn: 0.1% or more and 1.0% or less, satisfying $0.2 \leq Al/(Si+Al) \leq 0.6$, the balance being Fe and unavoidable impurity elements, and has a yield ratio of 0.6 or more and a Vickers hardness of 200 or less.

Patent Document 4 aims to provide a non-oriented electrical steel sheet which can solve a problem that the sheet bends or buckles when punched into a shape of core. The disclosed non-oriented electrical steel sheet comprises, in terms of by mass %, C: 0.05% or less, P: 0.2% or less, Si: 5% or less, Mn: 5% or less, Al: 3% or less, S: 0.02% or less and N: 0.01% or less, and has TP value=P (222)/P (200) of 1.3 or more, using the ratio P (hkl) (wherein (hkl) is the orientation of the (hkl) plane in the sheet surface) of the X-ray integrated reflection intensity to the theoretical intensity, and has recrystallization rate of 20% or less.

CITATION LIST

Patent Literature

Patent Document 1: Japanese Unexamined Patent Publication (Kokai) No. 2005-113158

Patent Document 2: Japanese Unexamined Patent Publication (Kokai) No. 2008-050685

Patent Document 3: Japanese Unexamined Patent Publication (Kokai) No. 2011-140683

Patent Document 4: Japanese Unexamined Patent Publication (Kokai) No. 2008-202070

SUMMARY

Technical Problem

Most of the iron cores for drive motors of eco-cars such as EVs (electric vehicles) and HEVs (hybrid vehicles) are a laminated body (stacked core) of thin non-oriented electrical steel sheets with a thickness of 0.30 mm or less. In the production thereof, a continuous punching method by a progressive die is widely adopted as a highly productive method. Recently, there is a tendency to increase the continuous punching speed (the transfer speed of the steel sheet during the progressive punching) in order to further improve the productivity. However, in the non-oriented electrical steel sheet described in Patent Documents 1 to 4, the steel sheet being transported may have a possibility to be detached from the transport surface and the horizontal plane on which the punching mold is installed during the high-speed punching (the sheet may flap on the transport surface in the up- and down direction perpendicular to the transport direction). As a result, it is necessary to reduce the transfer speed, which not only hinders the improvement of productivity, but also causes troubles in the punching process if the sheet is not properly transported to the punching position. Accordingly, it was found that the productivity was greatly reduced.

An object of the present invention is to provide a non-oriented electrical steel sheet and a method for manufacturing a stacked core using the non-oriented electrical steel sheet, which can improve the above-mentioned transportability of the steel sheet even when continuously punching at a high speed.

Solution to Problems

It was presumed that the buckling strength of the steel sheet was insufficient as the cause of the deterioration of the transportability of the steel sheet when continuously punching at a high speed using the non-oriented electrical steel sheet. Then, in order to improve the buckling strength, it was conceived that it is effective to set both a yield strength and Young's modulus of the steel sheet to high values. Furthermore, it was found that this effect is likely to be exhibited in steel grades having a relatively high Mn or C content.

When both the yield strength and Young's modulus of the steel sheet for which the Mn and C contents were specified were set to high values, based on the above presumption, the transportability of the steel sheet could be improved during the continuous punching at a high speed.

The present invention has been made based on the above findings, and the gist thereof is as follows.

[1] A non-oriented electrical steel sheet characterized in that it comprises, by mass %, Si: 2.0 to 5.0%, Mn: 0.4 to 5.0%, Al≤3.0%, C: 0.0008 to 0.0100%, N≤0.0030%, S≤0.0030%, Ti≤0.0060%, the balance being Fe and unavoidable impurities, and that the product of the contents of Mn and C is in the range of 0.004 to 0.05 (mass %)$^2$, and the steel sheet has a yield strength in the rolling direction of 600 MPa or more and Young's modulus in the rolling direction of 200 GPa or more.

[2] The non-oriented electrical steel sheet according to item [1], characterized in that it further comprises, by mass %, 0.001 to 0.50% of one or more of Ni, Cr, Mo, Sn and Sb in total.

[3] A method of manufacturing a stacked core using a progressive die using the non-oriented electrical steel sheet having an excellent continuous punching property according to item [1] or [2] as a base material, characterized in that a transfer speed of the steel sheet V (m/s), satisfies the following Formula (1), $$V: V_{MIN} - V_{MAX} \quad (1),$$

wherein $$V_{MAX} = (1/25)\sqrt{(t^2 \times E \times YS)} \quad (2),$$

and $$V_{MIN} = (1/25)\sqrt{(t^2 \times 120{,}000)} \quad (3)$$

and wherein t: the sheet thickness of the electrical steel sheet (mm), E: Young's modulus of the electrical steel sheet in the rolling direction (GPa), and YS: the yield strength of the electrical steel sheet in the rolling direction (MPa).

[4] The method of manufacturing a stacked core according to item [3], characterized in that the produced stacked core is subject to a stress relief annealing at 750 to 900° C.

Advantageous Effect of Invention

According to the present invention, by setting the yield strength of the non-oriented electrical steel sheet in the rolling direction to 600 MPa or more and the Young's modulus in the rolling direction to 200 GPa or more, the transportability of the steel sheet can be improved when continuously punching at a high speed.

DESCRIPTION OF EMBODIMENTS

All of the inventions described in Patent Documents 1 to 4 aim at improving the punching property of a steel sheet. Patent Document 1 has a raised a problem as a punching property that the steel sheet becomes brittle as the strength increases and the productivity and yield deteriorate remarkably, and has proposed a material which does not cause embrittlement while having a yield stress of 400 MPa or more. Patent Document 2 raised a problem as a punching property that the punched motor core is cracked and the yield and productivity are deteriorated, and has proposed a material having a yield strength of 650 MPa or more and an elongation at break of 10% or more. Patent Document 3 aims to achieve a punching property by forming a punched end face, a fastened portion, or the like into a predetermined shape as an iron core, and has proposed a material having a yield ratio of 0.6 or more and a Vickers hardness of 200 or less. Patent Document 4 has raised a problem as a punching property that, when punching is performed into the shape of a core, it becomes difficult to transport the steel sheet for stacking after punching due to breakage during punching, and has proposed a material for the steel sheet with less sagging is achieved when it is measured at the free edge of the steel sheet placed in a cantilever state.

On the other hand, in the case of high-speed punching, which the present invention deals with, it has been found for the first time that the problem is not the deterioration of transportability after punching due to breakage during punching, but the transportability of the steel sheet to the punching position but. The non-oriented electrical steel sheet having an excellent continuous punching property, which is the subject of the present invention, means a non-oriented electrical steel sheet having an excellent transportability to the punching position at the time of continuous punching.

Then, as a result of detailed examination by the present inventors, in order to obtain a non-oriented electrical steel sheet having an excellent transportability to the punching position at the time of continuous punching, which is the object of the present invention, it was found for the first time that the steel sheet is required to have a yield strength in the rolling direction of 600 MPa or more and Young's modulus in the rolling direction of 200 GPa or more. By improving the yield strength to 600 MPa or more, the elastic range of the material can be widened, thereby avoiding breakage during transportation. At the same time, by setting the Young's modulus to 200 GPa or more, deformation in the elastic range can be reduced, and flapping (vibration) of the steel sheet due to device vibration, resonance, or the like can be suppressed. The yield strength is preferably 620 MPa or more, more preferably 715 MPa or more. In addition, the Young's modulus is preferably 205 GPa or more, and more preferably 210 GPa or more. As for the "yield strength" defined in the present invention, "0.2% proof stress" is defined as "yield strength" for a steel sheet in which an upper yield point is not exhibited in a tensile test. Further, in the steel sheet in which the upper yield point is exhibited in a tensile test, the "upper yield point" is defined as the "yield strength". Further, a method for measuring "Young's modulus" defined in the present invention is not particularly limited, and a known measuring method is used. Specifically, "Young's modulus" is obtained from the slope of the elastic deformation region showing a linear relationship in the displacement-load curve obtained in a usual tensile test.

The yield strength and Young's modulus here are those at the time of punching and are measured with an electrical steel sheet with a coating. The changes in yield strength and Young's modulus caused by the coating are extremely slight and negligible.

Next, the reason for limiting the steel component of the present invention will be described. In addition, % means mass %. The contents range of Si, Mn, Al, C, N, S and Ti of the steel sheet of the present invention is not fundamentally and significantly different from the conventional component composition range known for a non-oriented electrical steel sheet. However, it is characterized in that the contents of Mn and C are particularly controlled within a specific range.

Si is a component that has an effect of reducing iron loss by increasing electrical resistance and reducing eddy current loss. In order to exert this effect, it is necessary for Si to contain 2.0% or more. On the other hand, if the content increases, the magnetic flux density decreases and the cost increases. Therefore, the content is set to 5.0% or less.

By containing Mn together with C, it has an effect of suppressing the flapping of the steel sheet during the high-speed punching. To obtain this effect, the Mn content is set to 0.4% or more. Further, Mn has an effect of increasing the electric resistance to reduce the eddy current loss, improving the primary recrystallization texture to reduce the hysteresis loss, and improving the magnetic flux density. If the Mn content is too large, the crystal grain growth property itself at the time of annealing decreases and the hysteresis loss increases, and thus the content is set to 5.0% or less. The Mn content is preferably 1.0% or more and 4.6% or less, more preferably 1.6 to 4.2%, and still more preferably 2.2 to 3.8%.

By containing C together with Mn, it has an effect of suppressing the flapping of the steel sheet during the high-speed punching. To obtain this effect, the content of 0.0008% or more is required. However, when the content exceeds 0.0100%, iron loss deterioration due to magnetic aging becomes remarkable. It is preferably 0.0021 to 0.0090%, and more preferably 0.0041 to 0.0080%.

Further, the contents of Mn and C should be such that the product of the respective contents is in the range of 0.004 to 0.05 (mass %)$^2$. If the product is less than 0.004, it is considered that the interaction between Mn and C as described below does not work, and a sufficient invention effect cannot be obtained. The upper limit of the product is determined from the upper limit of each of the above elements. The range is preferably 0.006 to 0.04 (mass %)$^2$, and more preferably 0.008 to 0.03 (mass %)$^2$.

The reason why the effect of the present invention is exhibited when Mn and C coexist at a relatively high concentration is not clear, but it is considered as follows. It is known that Mn and C have an interaction (so-called Mn—C dipole) that attracts each other in steel, and thus has a suppressing effect of long-distance diffusion of C. On the other hand, C is known to have a suppressing effect of vibration via internal friction. In the present invention, Mn is presumed to suppress the long-distance diffusion of C and amplify the suppressing effect of vibration via internal friction caused by the short-distance movement of C. The effect is presumed to be a synergistic effect due to the combination of attractive interaction between dislocations (lattice defects) and C with the attractive interaction between Mn and C.

Like Si, Al is also a component that has an effect of reducing iron loss by increasing electrical resistance and reducing eddy current loss. It also increases a ratio of magnetic flux density to saturated magnetic flux density and has an effect of improving magnetic flux density. If the Al content is too large, the saturation magnetic flux density itself decreases, which leads to a decrease in the magnetic flux density. Therefore, the Al content is set to 3.0% or less. The Al content is preferably 0.10% or more, but Al may not be contained.

N is 0.0030% or less because it produces a nitride and deteriorates the iron loss characteristics. Since S forms sulfide and deteriorates iron loss characteristics, it is set to 0.0030% or less. Ti may produce various precipitates such as TiN, TiS and TiC, which not only deteriorate the iron loss property but also completely fix C which is considered to play an important role in the present invention, as a carbide, resulting in eliminating the useful effect of the invention. Therefore, it is set to 0.0060% or less.

The non-oriented electrical steel sheet of the present invention may further contain at least one of Ni, Cr, Mo, Sn and Sb by mass % of 0.001 to 0.50% as an optional component. Ni, Cr, Mo, Sn and Sb each affect the formation of a recrystallized texture and exert a significant effect on improving the magnetic characteristics of the steel sheet, and these effects are exhibited at a content of 0.001% or more. On the other hand, if the content is too large, the effect on the recrystallized texture is saturated, and thus the upper limit of the content is set to 0.50% in total.

The method for manufacturing the non-oriented electrical steel sheet of the present invention will be described.

The non-oriented electrical steel sheet of the present invention can be produced by a usual process consisting of steelmaking, hot rolling (or hot rolling, hot rolled sheet annealing), pickling, cold rolling, and final annealing. The production conditions for hot rolling do not require any special conditions. For example, the slab heating temperature for hot rolling may be 1000 to 1200° C., and the winding temperature may be standard conditions such as 700° C. or lower. No special conditions are required for cold rolling.

In the production of the steel sheet of the present invention, the yield strength and Young's modulus can be kept within the range of the present invention by adjusting the conditions of final annealing. By lowering the final annealing temperature to, for example, 740° C. or lower, both the yield strength and Young's modulus can be increased. On the other hand, if the final annealing temperature is too low, the flatness of the steel sheet may be poor. Therefore, for a steel sheet having the component composition of the present invention, the final annealing temperature that satisfies the yield strength and Young's modulus of the present invention can be determined for each component composition while maintaining a good flatness of the steel sheet.

In addition, controlling the cooling rate of final annealing particularly acts advantageous on the manifestation of the effects of the present invention. Specifically, the average cooling rate in the temperature range of 600 to 100° C. may be 60° C./s or less. Further, it is preferable that the average cooling rate CR1 in the temperature range of 600 to 350° C. is 40° C./s or less, the average cooling rate CR2 in the temperature range of 350 to 100° C. is 40° C./s or more, and CR2−CR1>0° C./s. More preferably, CR2−CR1≥20° C./s. The reason why such a cooling pattern is preferable is not clear, but the steel sheet of the present invention containing a predetermined amount of Mn and C can achieve the effect, and it is particularly effective in increasing Young's modulus. Therefore, it is conceived that such a cooling pattern correlate to the interaction between Mn and C, which affects the short-distance movement of C, which in turn exerts a vibration suppressing effect.

Probably, when the average cooling rate is set to 40° C./s or less at 350° C. or higher, Mn—C pairs are generated by the diffusion of C, and the vibration suppression effect during steel sheet transportation can be obtained, whereas, when the average cooling rate is set to less than 40° C./s at 350° C. or lower, it is presumed that a carbide is formed from the Mn—C pair and the vibration suppression effect is lost.

When a high-speed punching was performed using the non-oriented electrical steel sheet of the present invention, a test was conducted to check how much faster the transfer speed of the steel sheet could be.

Incidentally, the transfer speed of the steel sheet is obtained by dividing the transport distance by the time required for purely transporting the steel sheet, which does not include the time required for punching. This is because the steel sheet is stationary when the steel sheet is punched in the high-speed punching process. Generally, the transfer speed of this steel sheet is about 1.1 to 1.5 times the total punching speed (calculated including the time required for punching and the time for purely transporting the steel sheet) in the high-speed punching process.

A non-oriented electrical steel sheet having components of Si: 3.2%, Mn: 1.0%, Al: 0.7% by mass %, the balance of Fe and unavoidable impurities was manufactured. By modifying the sheet thickness to 0.10 to 0.30 mm through hot rolling and cold rolling and changing the final annealing temperature after cold rolling, the steel sheet having a yield strength between 350 and 850 MPa, and Young's modulus of 170 to 230 GPa was prepared.

The width of the steel sheet is not particularly limited, but the width was set to 300 mm to 500 mm in consideration of handling with a general punching device.

Generally, the thinner the steel sheet, the more likely its flapping during transportation will occur. Therefore, the range of the sheet thickness of the steel sheet here is set to 0.10 mm, which is relatively thin, from the general thickness of 0.25 mm.

For a high-speed punching, the transfer speed was varied within the range of 1 to 4 m/s when manufacturing the stacked core using the progressive die.

As a result of the test, it was found that the limit of the transfer speed ($V_{MAX}$) of the steel sheet capable of performing continuous punching without causing flapping can be expressed by a specific function of the sheet thickness, Young's modulus and yield strength: $((1/25)\sqrt{(t^2 \times E \times YS)})$ when the yield strength and Young's modulus of the steel sheet are within the above range of the present invention. That is, it was found that the transportability in a high-speed punching is good when the transfer speed V (m/s) of the steel sheet does not exceed the $V_{MAX}$ obtained by the following Formula (2).

$$V_{MAX}=(1/25)\sqrt{(t^2 \times E \times YS)} \quad (2)$$

wherein, t: the sheet thickness of the electrical steel sheet (mm), E: Young's modulus of the electrical steel sheet in the rolling direction (GPa), and YS: the yield strength of the electrical steel sheet in the rolling direction (MPa).

On the other hand, when the yield strength and Young's modulus are the lower limits of the present invention, i.e., the yield strength is 600 MPa and the Young's modulus is 200 GPa, the $V_{MAX}$ of the above Formula (1) is $(1/25)\sqrt{(t^2 \times 120{,}000)}$, which makes it possible to operate at this transfer speed up to the upper limit. From the opposite viewpoint, it can be said that the steel sheet of the present invention is characterized in that the transfer speed can be increased to $(1/25)\sqrt{(t^2 \times 120{,}000)}$ or more. In the present invention, the limit of the transfer speed when the above-mentioned yield stress and Young's modulus are the lower limits of the steel sheet of the present invention is defined as $V_{MIN}$.

$$V_{MIN}=(1/25)\sqrt{(t^2 \times 120{,}000)} \quad (3)$$

Accordingly, the present invention is a method for continuously punching the steel sheet of the present invention in a range of a transfer speed of $V_{MIN}$ or more and VMAX or less, that is, a method for manufacturing a stacked core satisfying Formula (1).

$$V: V_{MIN} - V_{MAX} \quad (1)$$

Namely, in the method for manufacturing a stacked core of the present invention, it is possible to perform a continuous punching by using the steel sheet of the present invention in which the material is appropriately controlled, and appropriately adopting a high-speed transfer speed, which was difficult in the past. As a matter of course, in actual operation, even if the transfer speed of the steel sheet in the punching process is lower than that of $V_{MIN}$, problems in transportability such as flapping do not occur. As an example, when the processing speed of the steps before and after the punching step is rate-limiting, the transfer speed in the punching step may be lower than $V_{MIN}$.

It should be noted that even a steel sheet that does not satisfy the yield strength and Young's modulus required by the steel sheet of the present invention also has a range of transfer speeds specified by the above-mentioned $V_{MIN}$ and $V_{MAX}$. For example, even if Young's modulus is too low to satisfy the present invention, if only the yield strength is sufficiently high, the value of $V_{MAX}$ becomes a value sufficiently higher than that of $V_{MIN}$, and there is a transfer speed satisfying Formula (1). However, such a steel sheet causes a problem in transportability even if the transfer speed is within the range of Formula (1). This is because it is necessary to satisfy both the yield strength and Young's modulus at the same time in addition to the steel component in order to realize the effect of the present invention.

After manufacturing a stacked core using the non-oriented electrical steel sheet of the present invention, the manufactured stacked core is subject to a stress relief annealing at 750 to 900° C. in order to obtain a core with less iron loss. As a result, the strain of the manufactured stacked core disappears, the core iron loss is reduced, and a high-efficiency motor can be manufactured. If the stress relief annealing temperature is less than 750° C., the crystal grain size of the steel sheet does not grow sufficiently, resulting in fine grains. On the other hand, when the stress relief annealing temperature exceeds 900° C., the stacked steel sheets stick to each other and the core iron loss increases. Therefore, the stress relief annealing temperature was set in the range of 750 to 900° C. In the annealing atmosphere of stress relief annealing, it is preferable to reduce a concentration of an oxidizing gas.

EXAMPLES

The molten steel melted in a converter was continuously cast to obtain slabs having the component compositions shown in Table 1. To these slabs, hot rolling, annealing after hot rolling, and cold rolling are performed by a conventional method to obtain cold rolled sheets having a sheet thickness of 0.25 mm to 0.10 mm. These cold-rolled sheets were final-annealed at the temperature and cooling rate shown in Table 1 to obtain non-oriented electrical steel sheets, and steel strips having a sheet width of 410 mm were sampled by slitting. The final annealing atmosphere was 100% nitrogen. The yield strength in the rolling direction and Young's modulus in the rolling direction were measured for the manufactured non-oriented electrical steel sheets, and were shown in Table 2. Here, for Reference Examples No. 20 and 28, since the final annealing temperature was too low and the flatness of the steel sheet was poor, the subsequent evaluation of high-speed punching property and the evaluation of iron loss were not performed. In all the examples, the N content was 0.0030% or less, the S content was 0.0030% or less, and the Ti content was 0.0060% or less.

Regarding the evaluation of high-speed transportability, when manufacturing a stacked core using a progressive die, the transfer speed was varied within the range of 2.0 to 4.0 m/s for a steel sheet having a sheet thickness of 0.25 mm, within the range of 1.5 to 2.5 m/s for a steel sheet having a sheet thickness of 0.15 mm, and within the range of 0.8 to 1.7 m/s for a steel sheet having a sheet thickness of 0.10 mm. Regarding the evaluation of high-speed transportability, "O" was displayed in Table 2 as a good example in which normal punching and stacking could be performed without flapping, and "x" was displayed in Table 2 as a defect for the other cases. Examples of defective cores marked with "x" include poor shape such as a partial step in the stacking thickness direction of the stacked core, or core caulking (cracking) during post-process motor assembly. It is considered that the steel sheet is flapped as a cause of the defective core. Flapping means that the steel sheet is deformed or buckled, and as a result, the steel sheet detaches in the vertical direction perpendicular to the horizontal plane on which the transport surface and the punching die are installed. Regarding the transportability, it was judged to be "pass" if no problem occurred at any transfer speed of $V_{MIN}$ or less and $V_{MAX}$ or less. If a problem occurs at a speed of at least one of the transfer speeds of $V_{MIN}$ or less and $V_{MAX}$ or less, it is judged as "fail", and an underline was placed under the symbol "x".

In Table 2, for Nos. 1 to 19 (series with a sheet thickness of 0.25 mm), all examples were "O" at the transfer speed of 2.0 m/s. For transfer speeds slower than that, no problem would occur. Therefore, the symbol "-" was displayed without testing. Similarly, for Nos. 21 to 27 (series with a sheet thickness of 0.15 mm), if the transfer speed is slower than 1.5 m/s, no problem would occur. Therefore, the symbol "-" was displayed without testing.

TABLE 1

| | | Component (by mass %) | | | | | Mn × C | Final Annealing Annealing Temperature | Cooling Rate 600⇒350° C. | Cooling Rate 350⇒100° C. | Sheet Thickness |
|---|---|---|---|---|---|---|---|---|---|---|---|
| | No. | C | Si | Mn | Al | others | (mas %)$^2$ | (° C.) | (° C./s) | (° C./s) | (mm) |
| Inv.Ex. | 1 | 0.0040 | 3.2 | 1.0 | 0.7 | | 0.0040 | 700 | 20 | 60 | 0.25 |
| | 2 | 0.0050 | 2.3 | 3.2 | 0.2 | | 0.0160 | 700 | 20 | 60 | 0.25 |
| | 3 | 0.0075 | 3.2 | 1.0 | 0.7 | Ni:0.2 | 0.0075 | 680 | 20 | 60 | 0.25 |
| | 4 | 0.0085 | 3.2 | 1.0 | 0.7 | Cr:0.1 | 0.0085 | 710 | 20 | 60 | 0.25 |
| | 5 | 0.0095 | 3.2 | 1.0 | 0.7 | Mo:0.02 | 0.0095 | 740 | 20 | 60 | 0.25 |
| | 6 | 0.0066 | 3.2 | 1.0 | 0.7 | Sn:0.03 | 0.0066 | 700 | 20 | 60 | 0.25 |
| | 7 | 0.0055 | 3.7 | 2.2 | 0.0 | Sb:0.02 | 0.0121 | 660 | 20 | 60 | 0.25 |
| | 8 | 0.0010 | 2.4 | 4.0 | 0.2 | | 0.0040 | 680 | 20 | 60 | 0.25 |
| | 9 | 0.0080 | 3.3 | 0.6 | 0.9 | | 0.0048 | 700 | 20 | 60 | 0.25 |
| | 10 | 0.0050 | 2.1 | 4.2 | 0.6 | | 0.0210 | 650 | 20 | 60 | 0.25 |
| | 11 | 0.0040 | 3.2 | 1.0 | 0.7 | | 0.0040 | 700 | 20 | 20 | 0.25 |
| | 12 | 0.0050 | 2.3 | 3.2 | 0.2 | | 0.0160 | 700 | 20 | 20 | 0.25 |
| | 13 | 0.0040 | 3.2 | 1.0 | 0.7 | | 0.0040 | 700 | 60 | 60 | 0.25 |
| | 14 | 0.0050 | 2.3 | 3.2 | 0.2 | | 0.0160 | 700 | 60 | 60 | 0.25 |
| Comp.Ex. | 15 | 0.0030 | 3.2 | 1.0 | 0.7 | | 0.0030 | 750 | 20 | 60 | 0.25 |
| | 16 | 0.0045 | 3.2 | 1.0 | 0.7 | | 0.0045 | 800 | 20 | 60 | 0.25 |
| | 17 | 0.0040 | 3.2 | 1.0 | 0.7 | | 0.0040 | 800 | 20 | 60 | 0.25 |
| | 18 | 0.0025 | 3.2 | 1.0 | 0.7 | | 0.0025 | 700 | 20 | 60 | 0.25 |
| | 19 | 0.0025 | 3.2 | 1.0 | 0.7 | | 0.0025 | 680 | 20 | 60 | 0.25 |
| Ref.Ex. | 20 | 0.0025 | 3.2 | 1.0 | 0.7 | | 0.0025 | 650 | 20 | 60 | 0.25 |
| Inv.Ex. | 21 | 0.0029 | 2.8 | 3.0 | 0.1 | | 0.0087 | 690 | 20 | 60 | 0.15 |
| | 22 | 0.0029 | 2.8 | 3.0 | 0.1 | | 0.0087 | 690 | 20 | 20 | 0.15 |
| | 23 | 0.0029 | 2.8 | 3.0 | 0.1 | | 0.0087 | 590 | 60 | 60 | 0.15 |
| | 24 | 0.0029 | 2.8 | 3.0 | 0.1 | | 0.0087 | 690 | 60 | 20 | 0.15 |
| | 25 | 0.0021 | 2.8 | 3.0 | 0.1 | | 0.0063 | 690 | 20 | 60 | 0.15 |
| | 26 | 0.0016 | 2.8 | 3.0 | 0.1 | | 0.0048 | 690 | 20 | 60 | 0.15 |
| Comp.Ex. | 27 | 0.0012 | 2.8 | 3.0 | 0.1 | | 0.0036 | 680 | 20 | 60 | 0.15 |
| Ref.Ex. | 28 | 0.0012 | 2.8 | 3.0 | 0.1 | | 0.0036 | 650 | 20 | 60 | 0.15 |
| Inv.Ex. | 29 | 0.0021 | 2.8 | 3.0 | 0.1 | | 0.0063 | 690 | 20 | 60 | 0.10 |
| | 30 | 0.0016 | 2.8 | 3.0 | 0.1 | | 0.0048 | 690 | 20 | 60 | 0.10 |

| | | Mechanical Characteristics | | Formula | Formula | | | | | | | | | | Iron Loss | |
|---|---|---|---|---|---|---|---|---|---|---|---|---|---|---|---|---|
| | | Yield Strength | Young Modulus | (3) $V_{MIN}$ | (2) $V_{MAX}$ | High Speed Transportability (Transfer speed(m/s)) | | | | | | | | | After Stress Relief Annealing | |
| | No. | (Mpa) | (Gpa) | (m/s) | (m/s) | 0.8 | 1.2 | 1.5 | 1.7 | 2.0 | 2.5 | 3.0 | 3.5 | 4.0 | (W10/200, W/kg) | Remarks |
| Inv.Ex. | 1 | 710 | 206 | 3.5 | 3.8 | — | — | — | — | O | O | O | O | O | 4.1 | |
| | 2 | 620 | 220 | 3.5 | 3.7 | — | — | — | — | O | O | O | O | O | 3.6 | |
| | 3 | 725 | 220 | 3.5 | 4.0 | — | — | — | — | O | O | O | O | O | 4.2 | |
| | 4 | 740 | 215 | 3.5 | 4.0 | — | — | — | — | O | O | O | O | O | 4.2 | |
| | 5 | 650 | 209 | 3.5 | 3.7 | — | — | — | — | O | O | O | O | O | 3.9 | |
| | 6 | 719 | 216 | 3.5 | 3.9 | — | — | — | — | O | O | O | O | O | 3.6 | |

-continued

| | No. | Mechanical Characteristics Yield Strength (Mpa) | Young Modulus (Gpa) | Formula (3) $V_{MIN}$ (m/s) | Formula (2) $V_{MAX}$ (m/s) | High Speed Transportability (Transfer speed(m/s)) 0.8 | 1.2 | 1.5 | 1.7 | 2.0 | 2.5 | 3.0 | 3.5 | 4.0 | Iron Loss After Stress Relief Annealing (W10/200, W/kg) | Remarks |
|---|---|---|---|---|---|---|---|---|---|---|---|---|---|---|---|---|
| | 7 | 756 | 211 | 3.5 | 4.0 | — | — | — | — | O | O | O | O | O | 3.9 | |
| | 8 | 644 | 208 | 3.5 | 3.7 | — | — | — | — | O | O | O | O | × | 4.0 | |
| | 9 | 720 | 214 | 3.5 | 3.9 | — | — | — | — | O | O | O | O | × | 3.9 | |
| | 10 | 636 | 220 | 3.5 | 3.7 | — | — | — | — | O | O | O | O | × | 4.7 | |
| | 11 | 711 | 202 | 3.5 | 3.8 | — | — | — | — | O | O | O | O | × | 4.1 | |
| | 12 | 602 | 201 | 3.5 | 3.5 | — | — | — | — | O | O | O | O | × | 3.7 | |
| | 13 | 717 | 204 | 3.5 | 3.8 | — | — | — | — | O | O | O | O | × | 4.1 | |
| | 14 | 610 | 204 | 3.5 | 3.5 | — | — | — | — | O | O | O | O | × | 3.6 | |
| Comp.Ex. | 15 | 600 | 198 | 3.5 | 3.4 | — | — | — | — | O | O | O | × | × | 4.2 | |
| | 16 | 538 | 189 | 3.5 | 3.2 | — | — | — | — | O | O | O | × | × | 4.4 | |
| | 17 | 400 | 170 | 3.5 | 2.6 | — | — | — | — | O | O | × | × | × | 4.6 | |
| | 18 | 610 | 198 | 3.5 | 3.5 | — | — | — | — | O | O | O | × | × | 4.3 | |
| | 19 | 683 | 198 | 3.5 | 3.7 | — | — | — | — | O | O | O | × | × | 4.3 | |
| Ref.Ex. | 20 | 730 | 212 | 3.5 | 3.9 | — | — | — | — | — | — | — | — | — | — | Poor Flatness |
| Inv.Ex. | 21 | 747 | 215 | 2.1 | 2.4 | — | — | O | O | O | O | — | — | — | 3.2 | |
| | 22 | 745 | 203 | 2.1 | 2.3 | — | — | O | O | O | × | — | — | — | 3.2 | |
| | 23 | 750 | 202 | 2.1 | 2.3 | — | — | O | O | O | × | — | — | — | 3.1 | |
| | 24 | 750 | 202 | 2.1 | 2.3 | — | — | O | O | O | × | — | — | — | 3.1 | |
| | 25 | 744 | 208 | 2.1 | 2.4 | — | — | O | O | O | O | — | — | — | 3.2 | |
| | 26 | 740 | 205 | 2.1 | 2.3 | — | — | O | O | O | O | — | — | — | 3.4 | |
| Comp.Ex. | 27 | 754 | 196 | 2.1 | 2.3 | — | — | O | O | × | × | — | — | — | 3.6 | |
| Ref.Ex. | 28 | 870 | 219 | 2.1 | 2.6 | — | — | — | — | — | — | — | — | — | — | Poor Flatness |
| Inv.Ex. | 29 | 731 | 201 | 1.4 | 1.5 | O | O | O | × | — | — | — | — | — | 2.8 | |
| | 30 | 729 | 205 | 1.4 | 1.5 | O | O | O | × | — | — | — | — | — | 2.9 | |

<<Sheet Thickness 0.25 mm>>

For Inventive Example of 1 to 14, both the yield strength and Young's modulus were within the range of the present invention, and the high-speed transportability was good at the transfer speed of $V_{MIN}$ or more and $V_{MAX}$ or less. On the other hand, for Comparative Example No. 15, Mn×C was out of the scope of the present invention. In Comparative Examples 16 and 17, the final annealing temperature was too high, and one or both of the yield strength and Young's modulus were out of the scope of the present invention. Therefore, the $V_{MIN}$ obtained by calculation is higher than $V_{MAX}$. As a result, there was a problem in transportability even at a transfer speed of $V_{MIN}$ or less. For Comparative Example Nos. 18 and 19, Mn×C was out of the range of the present invention and Young's modulus was out of the range of the present invention, a good transfer could not be performed at a transfer speed of $V_{MAX}$ or less.

<<Sheet Thickness 0.15 mm>>

For Inventive Example Nos. 21 to 26, both the yield strength and Young's modulus were within the range of the present invention, and even if the transfer speed of the steel sheet was set to a high speed in the range of $V_{MIN}$ or more and $V_{MAX}$ or less, the high-speed transportability was good. On the other hand, for Comparative Example No. 27, Mn×C was out of the range of the present invention, Young's modulus was out of the range of the present invention, and as a result, a problem occurred in the transportability at the transfer speed in the range of $V_{MAX}$ or less.

<<Sheet Thickness 0.10 mm>>

For Inventive Example Nos. 29 to 30, both the yield strength and Young's modulus were within the range of the present invention, and even if the transfer speed of the steel sheet was set to a high speed in the range of $V_{MIN}$ or more and $V_{MAX}$ or less, the high-speed transportability was good.

A stacked core was manufactured from a member punched at the highest transfer speed that did not cause any problems, and it was subject to a stress relief annealing at 800° C. In the stacked core, for the iron loss, a B coil and an exciting coil were wound around the back yoke portion and evaluated as a simulated ring, and the iron loss $W_{10/200}$ (W/kg) was shown in Table 2. If the iron loss $W_{10/200}$ was 5 W/kg or less, it was judged to be good. In both Inventive Examples and Comparative Examples, the iron loss was within the range where there was no problem in practical use, but the iron loss tended to be better in the Inventive Examples. This is considered because the steel of the present invention has a probability up to the upper limit of the transfer speed and the punching is good with an accuracy equal to or higher than the evaluation limit, or it is considered that, when the steel sheet which was controlled to be a higher values of the yield strength and Young's modulus under the conditions of Examples for final annealing was subjected to stress relief annealing to grow grains, the change in crystal structure (crystal orientation and grain size) acted in a favorable direction for iron loss.

The invention claimed is:

1. A non-oriented electrical steel sheet comprising, by mass %:

Si: 7.0 to 5.0%,

Mn: 0.4 to 5.0%, 0.1≤Al≤3.0%,

C: 0.0008 to 0.0100%,

N≤0.0030%,

S≤0.0030%,

Ti≤0.0060%, a balance of Fe and unavoidable impurities, wherein:

a product of the contents of Mn and C is in a range of 0.004 to 0.05 (mass %)$^2$, and the steel sheet has a yield strength in a rolling direction of 600 MPa, or more, and a Young's modulus in the rolling direction of 200 GPa or more.

2. The non-oriented electrical steel sheet according to claim 1, wherein the electrical steel further comprises, by mass %, 0.001 to 0.50% of one or more of Ni, Cr, Mo, Sn and Sb in total.

* * * * *